US011801549B2

(12) United States Patent
Skirke et al.

(10) Patent No.: US 11,801,549 B2
(45) Date of Patent: Oct. 31, 2023

(54) METHOD FOR REMOVING A BLIND RIVET IN A WORKPIECE ARRANGEMENT

(71) Applicant: Airbus Operations GmbH, Hamburg (DE)

(72) Inventors: Jörn Skirke, Hamburg (DE); Alexander Schäfer, Hamburg (DE)

(73) Assignee: Airbus Operations GmbH, Hamburg (DE)

( * ) Notice: Subject to any disclaimer, the term of this patent is extended or adjusted under 35 U.S.C. 154(b) by 87 days.

(21) Appl. No.: 17/526,081

(22) Filed: Nov. 15, 2021

(65) Prior Publication Data

US 2022/0134413 A1 May 5, 2022

Related U.S. Application Data

(63) Continuation of application No. PCT/EP2020/063224, filed on May 12, 2020.

(30) Foreign Application Priority Data

May 15, 2019 (DE) ..... 10 2019 112 731.9

(51) Int. Cl.
*B21J 15/50* (2006.01)
*B25B 27/18* (2006.01)

(52) U.S. Cl.
CPC ..... *B21J 15/50* (2013.01); *B25B 27/18* (2013.01)

(58) Field of Classification Search
CPC ..... B21J 15/50; B25B 27/18
See application file for complete search history.

(56) References Cited

U.S. PATENT DOCUMENTS 2,836,888 A 6/1958 Hargrove
4,698,909 A * 10/1987 Sleigh ..... B21J 15/50 30/182

(Continued)

FOREIGN PATENT DOCUMENTS

DE 750526 C 1/1945
DE 10 2009 053 162 A1 5/2011

(Continued)

OTHER PUBLICATIONS

German Search Report for Application No. 102019112731 dated Jan. 20, 2020.

(Continued)

*Primary Examiner* — Jason L Vaughan
*Assistant Examiner* — Amanda Kreiling
(74) *Attorney, Agent, or Firm* — KDW Firm PLLC

(57) ABSTRACT

A method for removing a blind rivet includes a workpiece arrangement having first and second surfaces and a connecting hole. A blind rivet is fixed in the hole and has a shell and screw through the shell extending coaxially along a common center axis, the shell having a shell head portion, straight portion, deformation portion and threaded portion having an internal thread. The straight portion is in the hole and the deformation portion and the threaded portion protrude out of the hole, the screw having a screw head portion and pin portion having an external thread. The screw is in the shell such that the deformation portion of the shell is deformed where the outside diameter of the deformed deformation portion is larger than the diameter of the hole. The shell is cut in the region of the thread portion and/or the deformation portion, and the blind rivet is removed from the hole.

31 Claims, 9 Drawing Sheets

(56) References Cited

U.S. PATENT DOCUMENTS

| | | | | |
|---|---|---|---|---|
| 6,240,614 | B1 | 6/2001 | Kojima et al. | |
| 6,427,336 | B1 * | 8/2002 | Kojima ..... | B26B 17/00 29/261 |
| 8,387,226 | B2 | 3/2013 | Weigel, Jr. et al. | |
| 2006/0165507 | A1 | 7/2006 | McEldowney et al. | |

FOREIGN PATENT DOCUMENTS

| | | | |
|---|---|---|---|
| DE | 10 2013 223 522 | A1 | 5/2015 |
| SU | 627901 | A1 | 10/1978 |
| WO | WO 2020/229488 | A1 | 11/2020 |

OTHER PUBLICATIONS

International Search Report for Application No. PCT/EP2020/063224 dated Jul. 20, 2020.

* cited by examiner

METHOD FOR REMOVING A BLIND RIVET IN A WORKPIECE ARRANGEMENT

CROSS-REFERENCE TO RELATED APPLICATIONS

This application is a continuation of and claims priority to PCT/EP2020/063224 filed May 12, 2020 which claims priority to German Patent Application No. 10 2019 112 731.9 filed May 15, 2019, the entire disclosures of which are incorporated by reference herein.

TECHNICAL FIELD

The disclosure herein relates to a method for removing a blind rivet in a workpiece arrangement. Further aspects of the disclosure herein relate to cutting tools for removing a blind rivet in a workpiece arrangement, in particular according to such a method.

BACKGROUND

Blind rivets are increasingly being used, particularly in aircraft construction, in order to allow increasing automation in the production process. This is primarily due to the fact that it is possible in the case of blind rivets to attach them from only one side of the workpiece arrangement to be connected. For the removal of blind rivets, which is often necessary, for example, for maintenance reasons, it has hitherto been necessary, however, to drill out the rivet, which is complicated, time-consuming and usually not possible without damage to the workpiece.

It is therefore the object of the disclosure herein to provide a simple and rapid method, which is as damage-free as possible, for removing a blind rivet in a workpiece arrangement.

SUMMARY

This object is achieved by a method disclosed herein.

First of all, a workpiece arrangement is provided in which there is a blind rivet. The workpiece arrangement comprises one or more workpieces which rest against one another and are to be connected, preferably aircraft structural components, such as, for example, skin elements of the fuselage or wing. The workpiece arrangement has a first surface and an opposite second surface and a hole, in particular a drilled hole or a bore, which connects the first surface to the second surface.

A blind rivet is fixed in the hole, the rivet having a shell and a screw extending through the shell, which screw is also referred to as a threaded stem. Both the shell and the screw preferably have a circular cross section. The screw is preferably formed from a stronger material than the shell. For example, the screw can be made of titanium and the shell can be made of steel. The screw is also referred to as a core or core bolt. The shell and the screw arranged therein extend coaxially along a common center axis between a first end on the same side as the first surface and a second end on the same side as the second surface of the workpiece arrangement.

When viewed along the center axis from the first end to the second end, the shell first has a shell head portion with a diameter which is greater than the diameter of the hole in the workpiece arrangement and, in this way, forms an abutment on the same side as the first end or the first surface. Adjoining this, the shell has a straight portion, the diameter of which, when viewed along the center axis, is preferably constant and the outside diameter of which is less than or equal to the diameter of the hole. Adjoining this, the shell has a deformation portion, which is formed from a deformable material and, in particular, can be deformed more easily than the threaded portion, with the result that, under axial load, the deformation portion is deformed first before any deformation of the threaded portion. Adjoining this, the shell also has a threaded portion with an internal thread. The straight portion is located in the hole and preferably rests by its outer surface against the hole wall, possibly with some play. The deformation portion and the threaded portion protrude from the hole on the same side as the second surface.

When viewed along the center axis from the first end to the second end, the screw first has a screw head portion with a diameter which is greater than the diameter of the hole. Adjoining this, the screw has a stem portion, the diameter of which, when viewed along the center axis, is preferably constant and is less than or equal to the inside diameter of the shell, in particular of the straight portion of the shell. When viewed along the center axis, at least part of the stem portion, preferably the part which has the second end, has an external thread.

The screw is arranged in the shell in such a way that the internal thread of the shell engages in the external thread of the screw and, by a rotary movement of the screw, the threaded portion is or has been moved axially along the stem portion in the direction of the first end, the deformation portion of the shell being or having been plastically deformed, in particular being or having been folded outward, away from the center axis, with the result that the outside diameter of the deformed deformation portion is greater than the diameter of the hole, and the deformation portion in this way forms an abutment on the same side as the second end or the second surface, which abutment preferably rests against the second surface. As a result, the blind rivet can only be fastened in the hole and hold the workpiece arrangement together by turning the screw at the first end, in particular at the screw head portion, i.e. from the same side as the first surface. The second surface side of the workpiece arrangement does not have to be accessible for this purpose.

To remove the blind rivet, the shell is then cut. In particular, the shell is cut in the region of the threaded portion and/or the deformation portion, i.e. on the same side as the second surface of the workpiece arrangement, preferably with a cutting tool which has a cutting edge which is moved toward the shell in the radial direction toward the center axis. The blind rivet is then removed from the hole.

In this way, the blind rivet can be removed quickly, simply and reliably without the need to drill the blind rivet out completely in a way that is complicated and damages the workpiece arrangement.

According to a preferred embodiment, the shell is cut with at least one cut parallel to the center axis. As a result, the shell bursts open along the cut, with the result that the diameter increases and the internal thread of the shell disengages from the external thread of the screw.

It is particularly preferred here if the cut extends at least along the threaded portion, preferably along the entire threaded portion. In this way, it is possible to release the engagement of the external thread and the internal thread.

In a preferred embodiment, the cutting of the shell is performed with a cutting tool which has a blade with a straight cutting edge which is moved toward the shell in the radial direction toward the center axis while aligned parallel to the center axis until the shell has been cut along the cutting edge, i.e. cut open. In this way, the shell can be cut with a single movement of the blade.

It is particularly preferred here if the cutting tool has a supporting body with an abutment surface for abutment against the second surface of the workpiece arrangement and with a bore starting from the abutment surface and matched to the outer shape of the threaded portion and preferably also of the deformation portion, and with a guide slot extending radially outward from the bore. The blade is arranged in the guide slot so as to be movable in a guided manner in such a way that the cutting edge preferably extends parallel to the central axis of the bore and can be moved into the bore and preferably toward the central axis. This represents a particularly simple and effective construction of the cutting tool.

To cut the shell, the cutting tool is arranged in such a way that the abutment surface rests against the second surface of the workpiece arrangement, and the blind rivet protruding from the hole at the second surface extends into or through the bore, such that the central axis of the bore runs coaxially with the center axis of the screw. After this, the blade is moved toward the shell in the direction of the center axis in the guide slot until the cutting edge cuts the shell, in particular the threaded portion of the shell. In this way, the shell can be cut very simply and reliably.

It is also particularly preferred if one or more further cutting edges are provided on the inner wall of the bore at a distance from the guide slot in the circumferential direction, preferably at a uniform distance, which cutting edge/s extends/extend parallel to the central axis and against which the threaded portion rests when the latter is located in the bore, such that the shell is also cut by the further cutting edges as a result of the pressure exerted on the shell by the cutting edge of the blade. As a result, the shell is cut from several sides, and the engagement of the thread can be released more easily and more quickly.

In a preferred embodiment, after the cutting of the shell, the screw is removed in the direction of the first surface. This is possible since, as a result of the cutting of the shell, the internal thread of the shell is no longer or no longer completely in engagement with the external thread of the screw, and therefore the screw can be released from the shell.

The removal of the screw is preferably effected by striking the second end of the screw, preferably in the axial direction. This is particularly useful if there is still slight residual engagement of the thread.

In a preferred embodiment, after the removal of the screw, the shell head portion is drilled out from the same side as the first surface and then removed. The drilling out is preferably carried out with a drill, the diameter of which corresponds to the outside diameter of the straight portion of the shell. As a result, the non-drilled-out outer, lateral part of the shell head portion is separated from the straight portion and can simply be removed, for example taken out, in the direction of the first surface.

After the removal of the shell head portion, the remaining parts of the shell, i.e. the straight portion, the deformation portion and the threaded portion, are preferably removed, for example taken out, on the same side as the second surface. The entire blind rivet has thus been removed from the hole.

According to an alternative embodiment of the method according to the disclosure herein, the shell is cut with at least one cut transverse, in particular perpendicular, to the center axis, i.e. in the circumferential direction. This enables the separated part of the shell to be unscrewed from the external thread of the screw and removed.

In this case, it is particularly preferred if the shell is cut at the transition between the deformation portion and the straight portion. According to the disclosure herein, this transition between the deformation portion and the straight portion also represents part of the deformation portion. In this way, it is possible to release the deformation portion, together with the threaded portion, from the straight portion and to unscrew it from the external thread of the screw.

In this case, it is also preferred if the shell is cut along an extension of the second surface. This is particularly simple since the cutting tool can be moved along the second surface.

It is furthermore preferred if, during the cutting of the shell, several cuts are made from different sides of the shell, for example two cuts from opposite sides of the shell. In this way, the shell can be cut uniformly and quickly from several sides.

In a preferred embodiment, the cutting of the shell is performed with a cutting tool which has a blade with a cutting edge which is moved toward the shell in the radial direction toward the center axis while aligned perpendicularly to the center axis until the shell has been cut along the cutting edge, i.e. cut open. In this way, the shell can be cut very simply.

In this case, it is particularly preferred if the cutting edge is moved between the second surface and the deformation portion in order to cut the shell. In this way, the blade can be guided along the second surface and the shell can be cut between the deformation portion and the straight portion.

It is also particularly preferred if several cuts are carried out in order to cut the shell, wherein the cutting tool is rotated about the center axis between the cuts, ensuring that the cuts are made at different angles, i.e. the cutting edge is moved toward the shell at a different angle for each cut. In this way, the shell can be cut completely from all sides.

Alternatively, it is preferred if, in order to cut the shell, the cutting edge is first moved toward the shell in the radial direction toward the center axis, and then the cutting tool is rotated about the center axis, with the result that the cutting edge cuts the shell continuously in the circumferential direction. In this way, the shell can be cut completely from all sides without having to carry out several separate cuts.

In a preferred embodiment, the blade is concavely curved relative to the shell. In this way, a larger area of the shell can be cut with one cut.

In this case, it is particularly preferred if the cutting edge has a radius of curvature greater than or equal to the internal radius of the shell. Particularly effective cutting can thereby be carried out.

In an alternative embodiment, however, the blade can also have a straight cutting edge. The shell is then preferably cut continuously in the circumferential direction by rotating the cutting tool relative to the shell about the center axis. A straight cutting edge represents a particularly simple and low-cost construction.

In a further preferred embodiment, the cutting tool has two blades with opposite cutting edges, which are moved toward the shell from opposite sides, in particular opposing sides, in order to cut the shell. In this case, the two cutting edges preferably have the same radius of curvature.

It is particularly preferred here if the cutting tool has a supporting body, preferably in the form of a frame, with an abutment surface for abutment against the second surface of the workpiece arrangement and with an opening extending perpendicularly along a central axis, starting from the abutment surface, into which the part of the blind rivet protruding from the hole at the second surface, in particular the threaded portion and the deformation portion of the shell, can extend and which is matched to the outer shape of the threaded portion of the shell and preferably also of the stem portion of the screw. The two blades with opposite cutting edges are arranged in the opening so as to be movable in a guided manner in such a way that the cutting edges preferably extend perpendicularly to the central axis and can be moved toward the central axis in the radial direction from opposite sides. This represents a particularly simple and effective construction of a cutting tool.

It is furthermore particularly preferred if, for cutting the shell, the cutting tool is arranged on the workpiece arrangement in such a way that the abutment surface rests against the second surface, and the blind rivet extends into or through the opening, with the result that the center axis runs coaxially with the central axis, after which the blades are moved toward the shell, preferably simultaneously, from opposite sides along the second surface, and cut the latter at the transition between the deformation portion and the straight portion. In this way, the shell can be cut particularly simply.

In a preferred embodiment, after the cutting of the shell, the threaded portion and the deformation portion are unscrewed from the external thread of the screw and removed on the same side as the second surface. The removal of the deformation portion thus also involves the removal of the abutment on the same side as the second surface, enabling the screw and the remaining parts of the shell to be removed on the opposite side, on which the first surface is situated.

In this case, it is preferred if, after the removal of the threaded portion and of the deformation portion, the screw is taken out, in particular pulled out or pressed out, in the direction of the first surface. This is now easily possible.

It is furthermore preferred if, after the removal of the screw or at the same time as the removal of the screw, the straight portion of the shell and the shell head portion are removed in the direction of the first surface. The blind rivet has thus been completely removed from the hole.

In an alternative embodiment, with the cutting of the shell, the screw extending in the shell is cut through, preferably along an extension of the second surface, at the same time, that is to say with a single cut or in the same cutting operation, after which the remaining part of the screw as well as the straight portion of the shell and the shell head portion are removed in the direction of the first surface. This represents a particularly simple and fast embodiment but requires that the cutting tool is capable of cutting the particularly strong screw, which is preferably made of titanium.

A further aspect of the disclosure herein relates to a first cutting tool for removing a blind rivet in a workpiece arrangement. The cutting tool is preferably suitable and intended for removing a blind rivet in a workpiece arrangement according to one embodiment of the method described above. In this context, the workpiece arrangement and the blind rivet are designed as described above.

In particular, the workpiece arrangement has a first surface and an opposite second surface and a hole, which connects the first surface to the second surface. The blind rivet is fixed in the hole, which blind rivet has a shell and a screw extending through the shell. The shell and the screw arranged therein extend coaxially along a common center axis between a first end on the same side as the first surface and a second end on the same side as the second surface of the workpiece arrangement. The shell has a shell head portion with a diameter which is greater than the diameter of the hole in the workpiece arrangement. Adjoining this, the shell has a straight portion, the outside diameter of which is less than or equal to the diameter of the hole. This is followed by a deformation portion and, finally, a threaded portion with an internal thread. The straight portion is located in the hole and the deformation portion and the threaded portion protrude from the hole on the same side as the second surface. The screw has a screw head portion with a diameter which is greater than the diameter of the hole, and, adjoining this, a stem portion, the diameter of which is less than or equal to the inside diameter of the shell. When viewed along the center axis, at least part of the stem portion has an external thread. The screw is arranged in the shell in such a way that the internal thread of the shell engages in the external thread of the screw and the deformation portion of the shell is deformed, with the result that the outside diameter of the deformed deformation portion is greater than the diameter of the hole.

The cutting tool has a supporting body with an abutment surface for abutment against the second surface of the workpiece arrangement and with a bore starting from the abutment surface and preferably matched to the outer shape of the threaded portion and preferably also of the deformation portion, and with a guide slot extending radially outward from the bore. A blade with a straight cutting edge is arranged in the guide slot so as to be movable in a guided manner in such a way that the cutting edge preferably extends parallel to the central axis of the bore and can be moved into the bore and preferably toward the central axis. The features and advantages explained further above in connection with the method also apply to the cutting tool under consideration.

According to a preferred embodiment, one or more further cutting edges are provided on the inner wall of the bore at a uniform distance from the guide slot in the circumferential direction, which cutting edge/s extends/extend parallel to the central axis and against which the threaded portion rests when the latter is located in the bore. In this way, as a result of the pressure exerted on the shell by the cutting edge of the blade, the shell can also be cut by the further cutting edges from another, preferably opposite, side.

A further aspect of the disclosure herein relates to a second cutting tool for removing a blind rivet in a workpiece arrangement. The cutting tool is preferably suitable and intended for removing a blind rivet in a workpiece arrangement according to one embodiment of the method described above. In this context, the workpiece arrangement and the blind rivet are designed as described above.

In particular, the workpiece arrangement has a first surface and an opposite second surface and a hole, which connects the first surface to the second surface. The blind rivet is fixed in the hole, which blind rivet has a shell and a screw extending through the shell. The shell and the screw arranged therein extend coaxially along a common center axis between a first end on the same side as the first surface and a second end on the same side as the second surface of the workpiece arrangement. The shell has a shell head portion with a diameter which is greater than the diameter of the hole in the workpiece arrangement. Adjoining this, the shell has a straight portion, the outside diameter of which is less than or equal to the diameter of the hole. This is followed by a deformation portion and, finally, a threaded portion with an internal thread. The straight portion is located in the hole and the deformation portion and the threaded portion protrude from the hole on the same side as the second surface. The screw has a screw head portion with a diameter which is greater than the diameter of the hole, and, adjoining this, a stem portion, the diameter of which is less than or equal to the inside diameter of the shell. When viewed along the center axis, at least part of the stem portion has an external thread. The screw is arranged in the shell in such a way that the internal thread of the shell engages in the external thread of the screw and the deformation portion of the shell is deformed, with the result that the outside diameter of the deformed deformation portion is greater than the diameter of the hole.

The cutting tool has a supporting body, preferably in the form of a frame, with an abutment surface for abutment against the second surface of the workpiece arrangement and with an opening starting from the abutment surface and having a central axis perpendicular to the abutment surface, into which the part of the blind rivet protruding from the hole at the second surface, in particular the threaded portion and the deformation portion of the shell, can extend and which is preferably matched to the outer shape of the threaded portion of the shell and preferably also of the stem portion of the screw. Two blades with opposite cutting edges are arranged in the opening so as to be movable in a guided manner in such a way that the cutting edges preferably extend perpendicularly to the central axis and can be moved toward the central axis in the radial direction from opposite sides. The features and advantages explained further above in connection with the method also apply to the cutting tool under consideration.

BRIEF DESCRIPTION OF THE DRAWINGS

Preferred example embodiments of the disclosure herein are explained in greater detail below with reference to a drawing. In the drawings.

DETAILED DESCRIPTION

Figure 1:
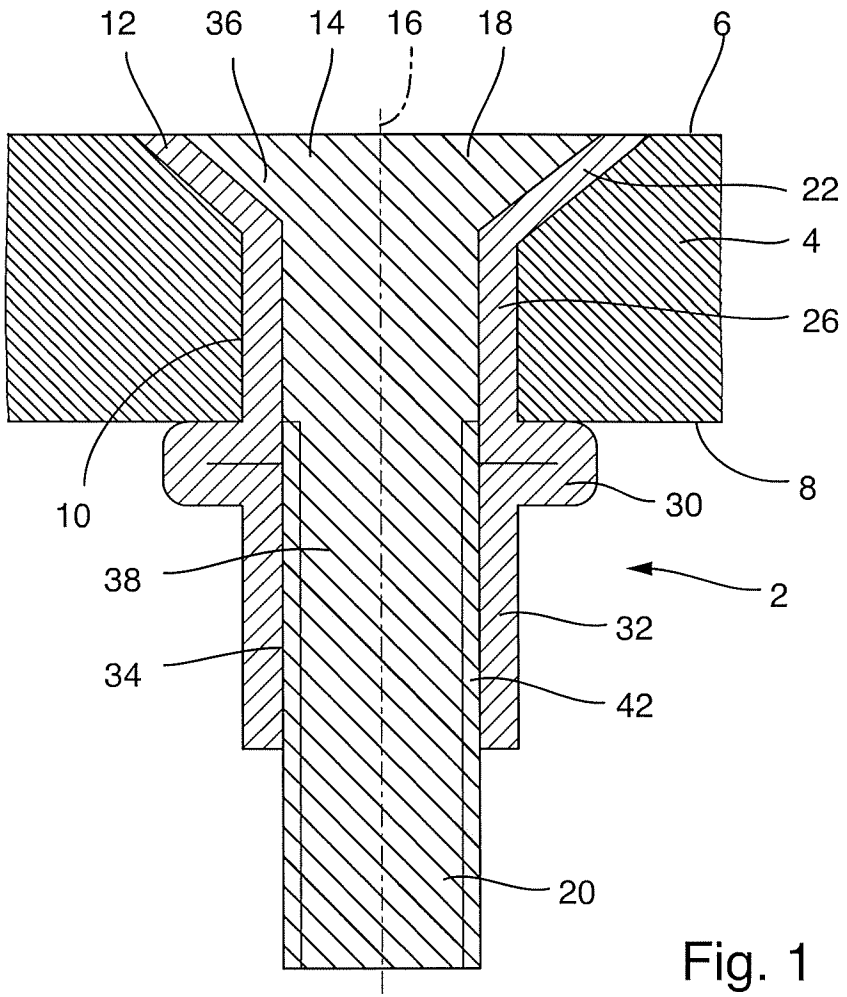
FIG. 1 shows a cross-sectional view parallel to the center axis of an illustrative blind rivet in a workpiece arrangement, which can be removed by a method according to the disclosure herein.

FIG. 1 shows an example embodiment of a blind rivet 2 which is fitted in a workpiece arrangement 4, from which the blind rivet 2 can be removed in a particularly simple, rapid and largely damage-free manner in accordance with the embodiments of the method according to the disclosure herein which are described below.

The workpiece arrangement 4 has a first surface 6 and an opposite second surface 8 and a hole 10, which connects the first surface 6 to the second surface 8. The blind rivet 2 is fixed in the hole 10, which blind rivet has a shell 12 and a screw 14 extending through the shell 12. Both the shell 12 and the screw 14 have a circular cross section. The screw 14 is made of titanium and the shell 12 is made of steel. The shell 12 and the screw 14 arranged therein extend coaxially along a common center axis 16 between a first end 18 on the same side as the first surface 6 and a second end 20 on the same side as the second surface 8 of the workpiece arrangement 4.

When viewed along the center axis 16 from the first end 18 to the second end 20, the shell 12 first has a shell head portion 22 with a diameter which is greater than the diameter of the hole 10 in the workpiece arrangement 4 and, in this way, forms an abutment on the same side as the first end 18 or the first surface 6. Adjoining this, the shell 12 has a straight portion 26, the diameter of which, when viewed along the center axis 16, is constant and the outside diameter of which is less than or equal to the diameter of the hole 10. Adjoining this, the shell 12 has a deformation portion 30, which is formed from a deformable material and, in particular, can be deformed more easily than the threaded portion 32, with the result that, under axial load, the deformation portion 30 is deformed first before any deformation of the threaded portion 32. Adjoining this, the shell 12 also has a threaded portion 32 with an internal thread 34. The straight portion 26 is located in the hole 10 and rests by its outer surface against the hole wall. The deformation portion 30 and the threaded portion 32 protrude from the hole 10 on the same side as the second surface 8.

When viewed along the center axis 16 from the first end 18 to the second end 20, the screw 14 first has a screw head portion 36 with a diameter which is greater than the diameter of the hole. Adjoining this, the screw 14 has a stem portion 38, the diameter of which, when viewed along the center axis 16, is constant and is less than or equal to the inside diameter of the shell 12, in particular of the straight portion 26 of the shell 12. When viewed along the center axis 16, the part of the stem portion 38 which has the second end 18 has an external thread 42.

The screw 14 is arranged in the shell 12 in such a way that the internal thread 34 of the shell 12 engages in the external thread 42 of the screw 14 and, by a rotary movement of the screw 14, the threaded portion 32 can be moved axially along the stem portion 38 in the direction of the first end 18, the deformation portion 30 of the shell 12 being plastically deformed, in particular being folded outward, away from the center axis 16, with the result that the outside diameter of the deformed deformation portion 30 is greater than the diameter of the hole 10, and the deformation portion 30 in this way forms an abutment on the same side as the second end 20 or the second surface 8, which abutment rests against the second surface 8. As a result, the blind rivet 2 is fastened in the hole 10 by turning the screw 14 at the screw head portion 36, and thus the workpiece arrangement 4 is held together.

To remove the blind rivet 2, the three embodiments of the method according to the disclosure herein which are described below are proposed. In all these embodiments, the shell 12 is first cut in the region of the threaded portion 32 and/or the deformation portion 30, i.e. on the same side as the second surface 8 of the workpiece arrangement 4, with a cutting tool 46 in such a way that a cutting edge 48 of the cutting tool 46 is moved toward the shell 12 in the radial direction toward the center axis 16.

According to the first embodiment, which is illustrated in FIGS. 2A through 6, the shell 12 is cut with at least one cut, in the embodiment under consideration with three cuts parallel to the center axis 16 and along the entire threaded portion 32. As a result, the shell 12 bursts open along the cuts, with the result that the diameter increases and the internal thread 34 of the shell 12 disengages from the external thread 42 of the screw 14.

Figure 2B:
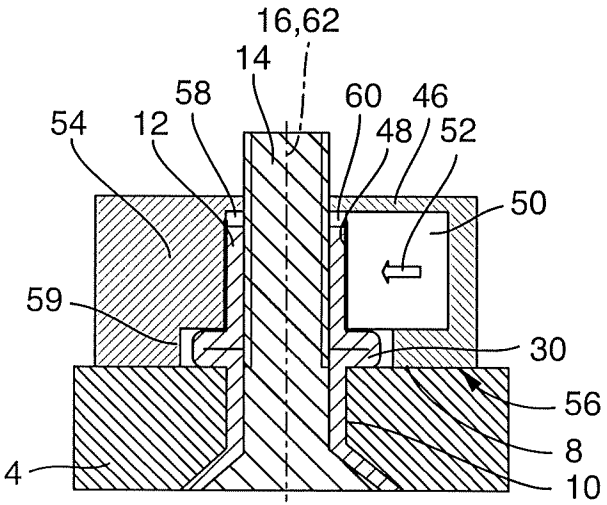
FIGS. 2A, 2B and 2C show three stepwise cross-sectional views parallel and perpendicular to the center axis of the blind rivet shown in FIG. 1 while the shell is being cut with a cut parallel to the center axis in accordance with a first embodiment of the method according to the disclosure herein.
Figure 2B:
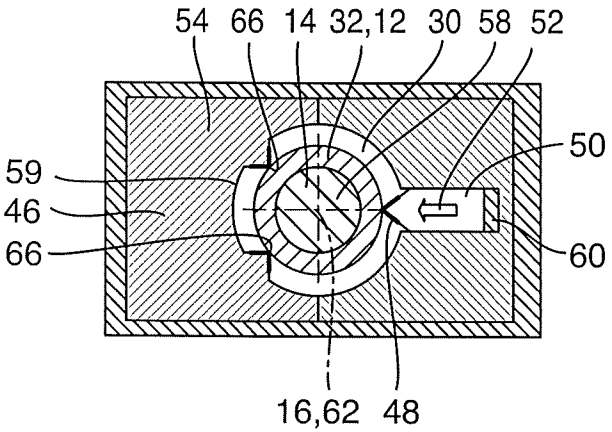
Figure 2A:
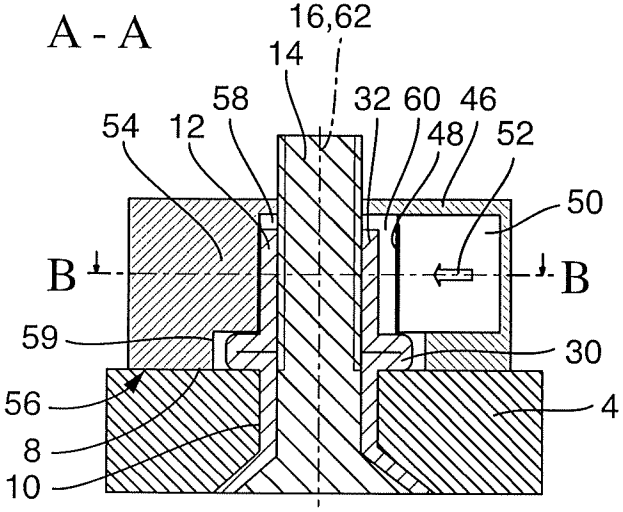
Figure 2A:
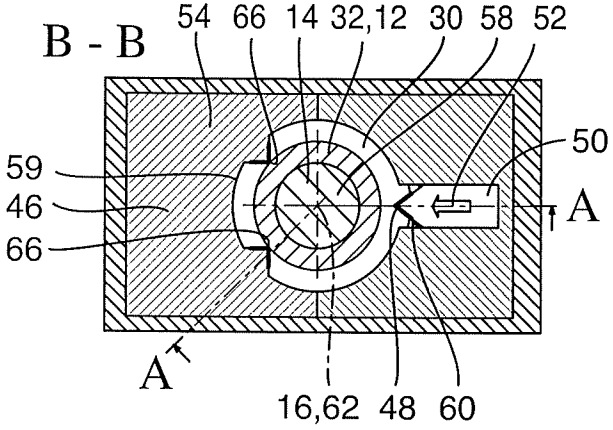
Figure 2C:
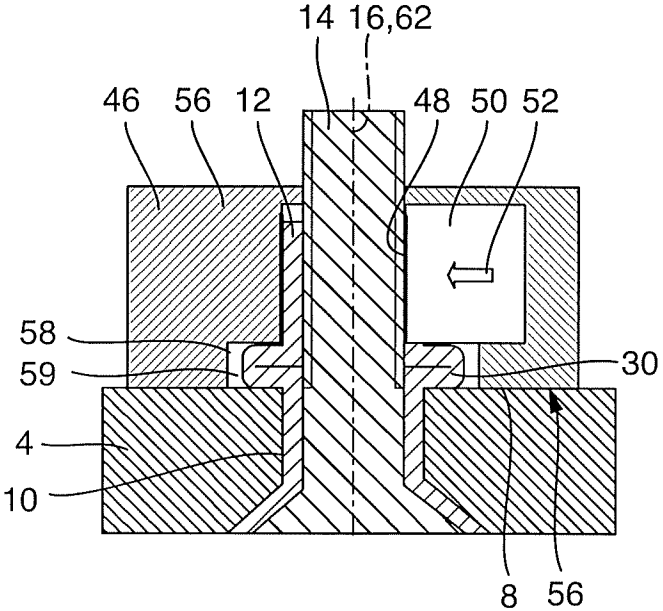
Figure 2C:
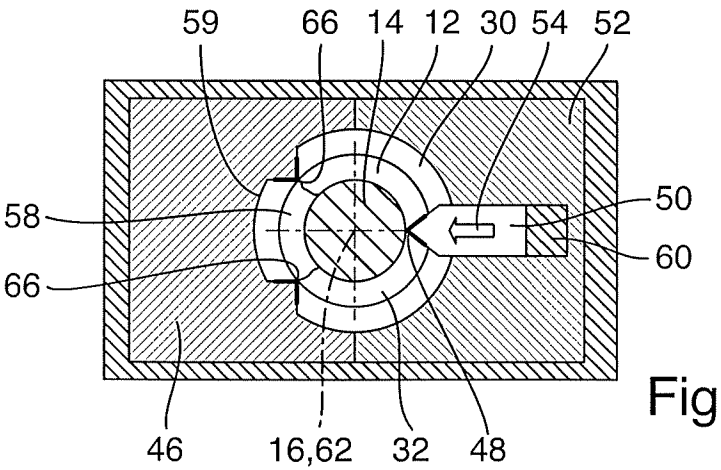

The cutting of the shell 12 in accordance with the first embodiment of the method is illustrated stepwise in FIGS. 2A-2C and is performed with a cutting tool 46 which has a blade 50 with a straight cutting edge 48, which is moved toward the shell 12 in the radial direction 52 toward the center axis 16 while aligned parallel to the center axis 16 until the shell 12 has been cut along the cutting edge 48. The cutting tool 46 furthermore has a supporting body 54 with an abutment surface 56 for abutment against the second surface 8 of the workpiece arrangement 4 and with a bore 58 starting from the abutment surface 56 and matched to the outer shape of the threaded portion 32 and of the deformation portion 30, and with a guide slot 60 extending radially outward from the bore 58. The blade 50 is arranged in the guide slot 60 so as to be movable in a guided manner in such a way that the cutting edge 48 extends parallel to the central axis 62 of the bore 58 and can be moved into the bore 58 toward the central axis 62.

Two further cutting edges 66 are provided on the inner wall 59 of the bore 58 at a uniform distance from the guide slot 60 in the circumferential direction, which cutting edges extend parallel to the central axis 62 and against which the threaded portion 32 rests when the latter is located in the bore 58, with the result that the shell 12 can also be cut by the further cutting edges 66 as a result of the pressure exerted on the shell 12 by the cutting edge 48 of the blade 50.

To cut the shell 12, the cutting tool 46 is arranged in such a way that the abutment surface 56 rests against the second surface 8 of the workpiece arrangement 4, and the blind rivet 2 protruding from the hole 10 at the second surface 8 extends through the bore 58, such that the central axis 62 of the bore 58 runs coaxially with the center axis 16 of the screw 14. After this, the blade 50 is moved toward the shell 12 in the direction of the center axis 16 in the guide slot 60 until the cutting edge 48 cuts the shell 12, in particular the threaded portion 32 of the shell 12, as is apparent in FIGS. 2A-2C. At the same time, the shell 12 is also pressed against the two further cutting edges 66 and cut by them on the sides opposite the blade 50.

Figure 3:
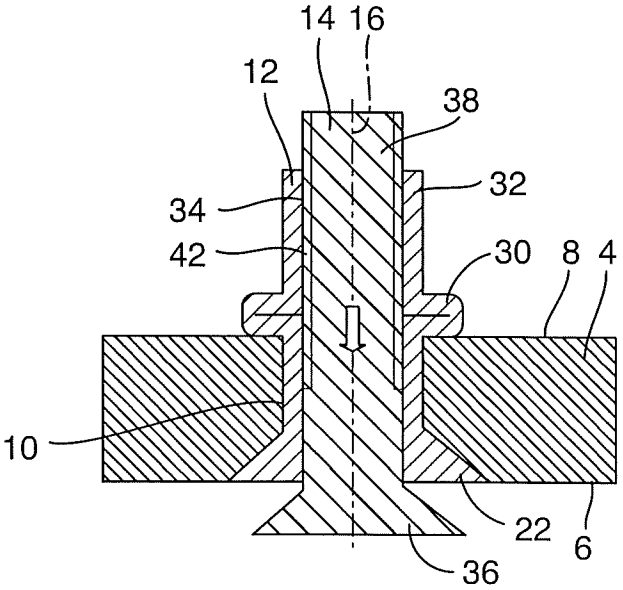
FIG. 3 shows a cross-sectional view parallel and perpendicular to the center axis of the blind rivet shown in FIG. 1 while the screw is being removed from the shell in accordance with the first embodiment of the method according to the disclosure herein.
Figure 3:
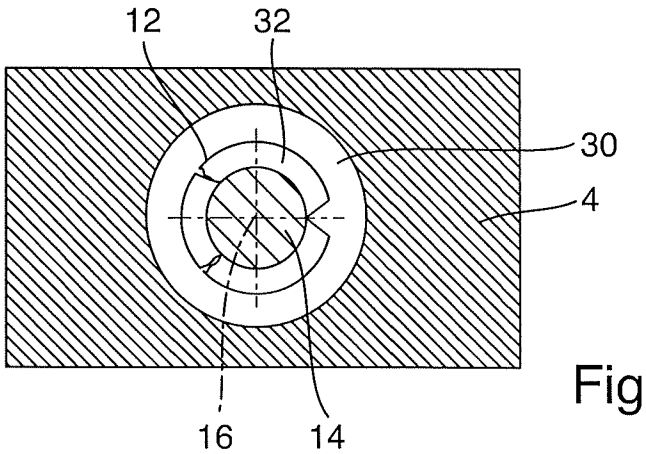

As shown in FIG. 3, after the cutting of the shell 12, the screw 14 is removed in the direction of the first surface 6 by striking the second end 20 of the screw 14. This is possible since, as a result of the cutting of the shell 12, the internal thread 34 of the shell 12 is no longer or no longer completely in engagement with the external thread 42 of the screw 14, and therefore the screw 14 can be released from the shell 12.

Figure 4:
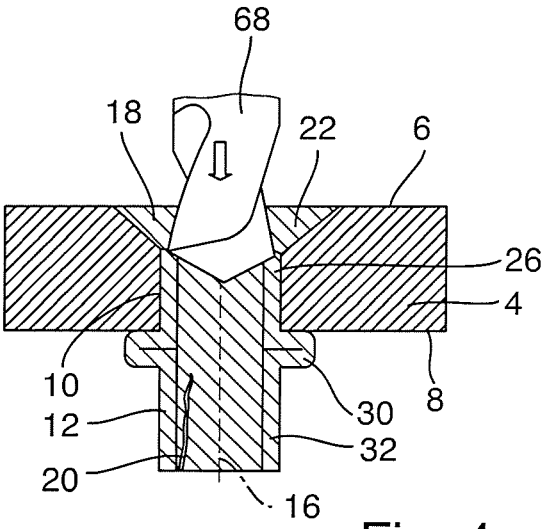
FIG. 4 shows a cross-sectional view parallel to the center axis of the blind rivet shown in FIG. 1 while the shell is being drilled out in accordance with the first embodiment of the method according to the disclosure herein.
Figure 5:
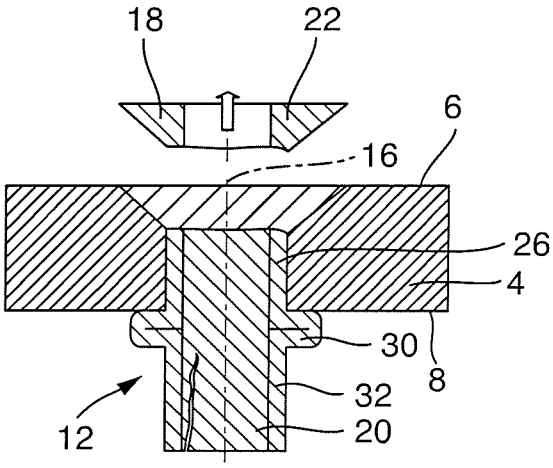
FIG. 5 shows a cross-sectional view parallel to the center axis of the blind rivet shown in FIG. 1 while residues of the drilled-out shell head portion are being removed in accordance with the first embodiment of the method according to the disclosure herein.

After the removal of the screw 14, the shell head portion 22 is drilled out from the same side as the first surface 6, as shown in FIG. 4. The drilling out is carried out with a drill 68, the diameter of which corresponds to the outside diameter of the straight portion 26 of the shell 12. As a result, the non-drilled-out outer, lateral part of the shell head portion 22 is separated from the straight portion 26 and can simply be removed in the direction of the first surface 6, as illustrated in FIG. 5.

Figure 6:
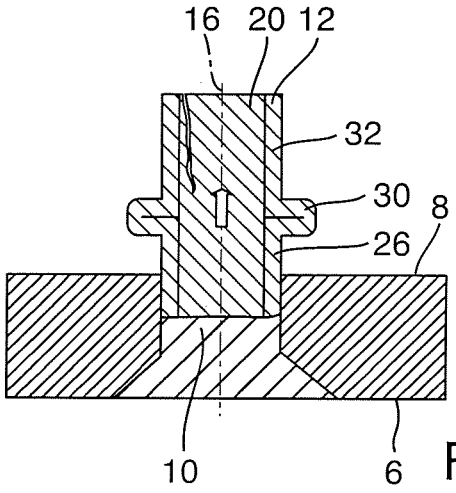
FIG. 6 shows a cross-sectional view parallel to the center axis of the blind rivet shown in FIG. 1 while the remaining parts of the shell are being removed in accordance with the first embodiment of the method according to the disclosure herein.
Figure 7A:
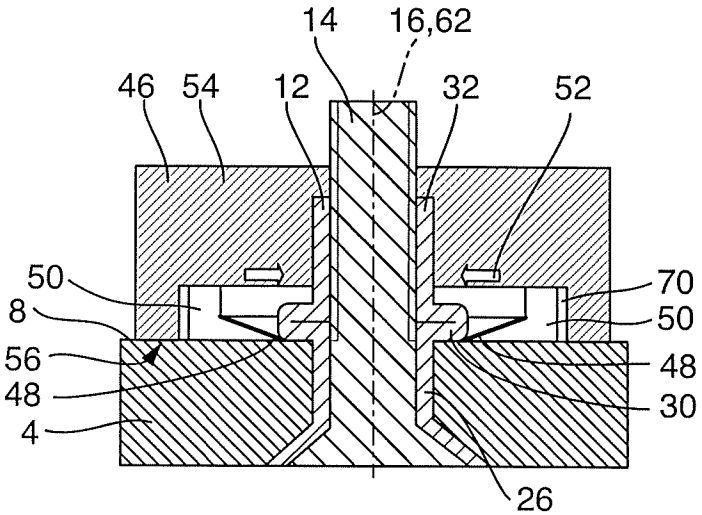
FIGS. 7A, 7B, 7C and 7D show four stepwise cross-sectional views parallel and perpendicular to the center axis of the blind rivet shown in FIG. 1 while the shell is being cut with a cut perpendicular to the center axis in accordance with a second embodiment of the method according to the disclosure herein.
Figure 7B:
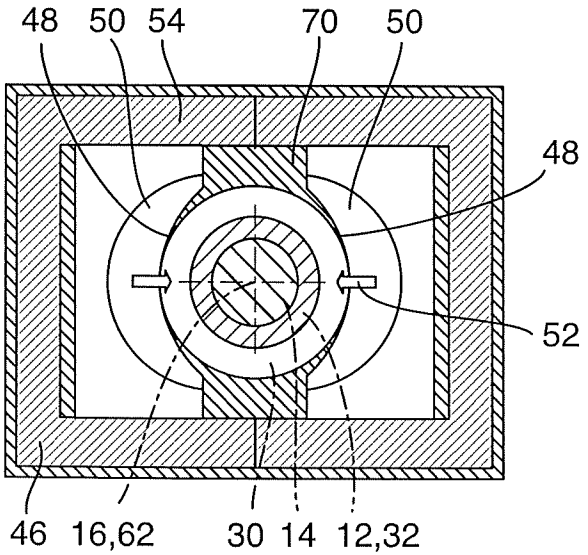
Figure 7D:
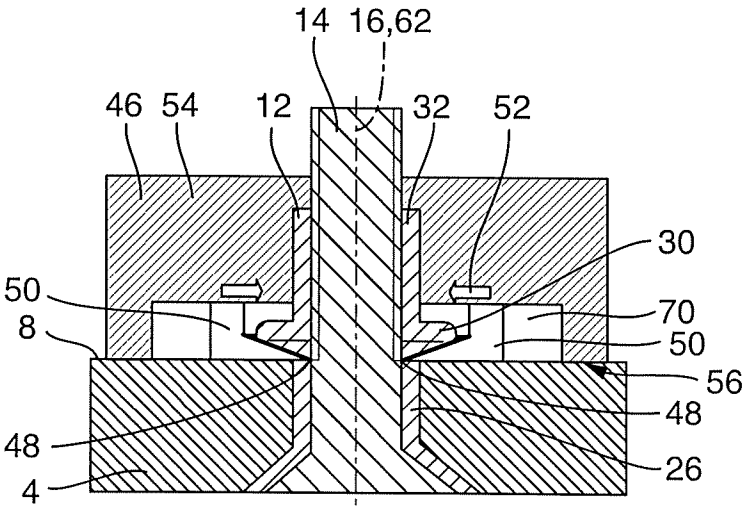
Figure 7D:
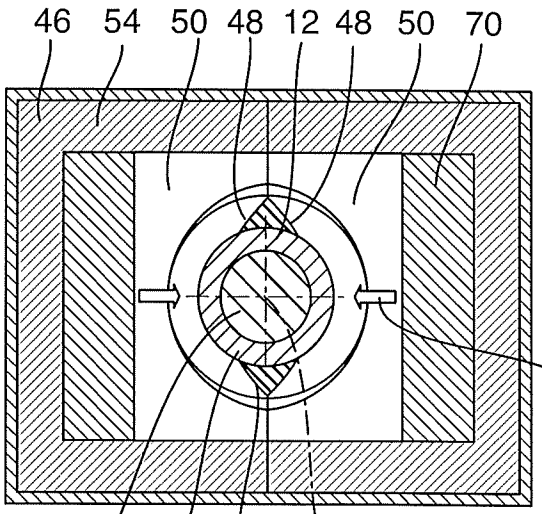
Figure 7C:
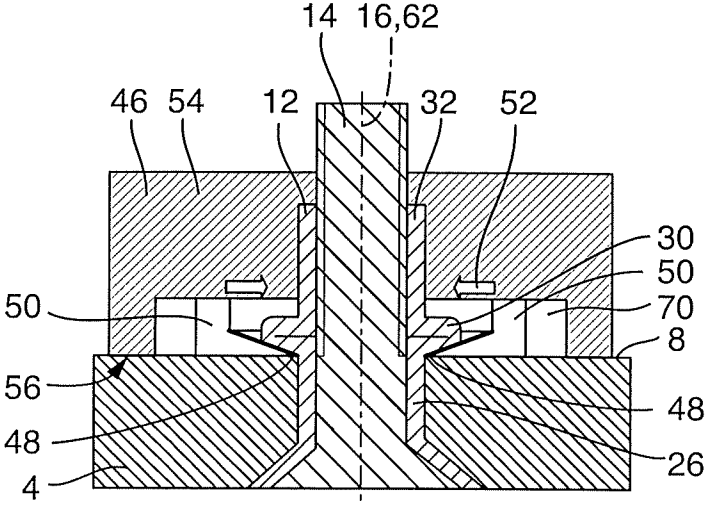
Figure 7C:
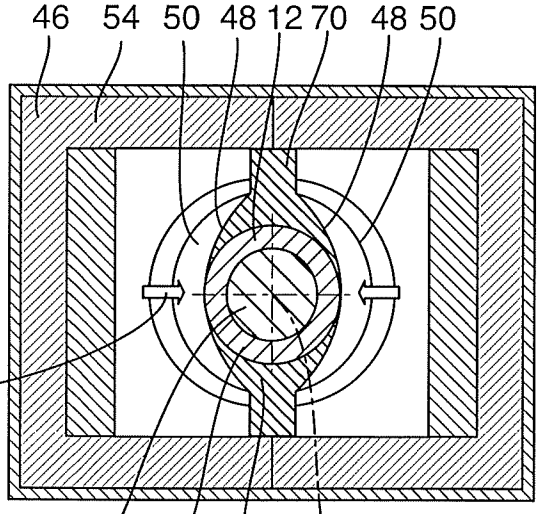

As shown in FIG. 6, after the removal of the shell head portion 22, the remaining parts of the shell 12, i.e. the straight portion 26, the deformation portion 30 and the threaded portion 32, are removed on the same side as the second surface 8. The entire blind rivet 2 has thus been removed from the hole 10.

According to the second embodiment of the method according to the disclosure herein for removing the blind rivet 2, which is illustrated in FIGS. 7 to 13, the shell 12 is cut with at least one cut perpendicular to the center axis 16 at the transition between the deformation portion 30 and the straight portion 26 and along an extension of the second surface 8. This enables the separated part of the shell 12, i.e. the deformation portion 30 and the threaded portion 32, to be unscrewed from the external thread 42 of the screw 14 and removed.

As illustrated in FIGS. 7A-7D, the cutting of the shell 12 is performed with a cutting tool 46 which has two blades 50 with opposite cutting edges 48, which, in order to cut the shell 12, are moved toward the shell 12 in the radial direction toward the center axis 16 from opposite sides while aligned perpendicularly to the center axis 16 until the shell 12 has been cut along the cutting edges 48. In the process, the cutting edges 48 are moved between the second surface 8 and the deformation portion 30. In this case, the blades 50 are concavely curved relative to the shell 12, the cutting edges 48 having an identical radius of curvature which is greater than the internal radius of the shell 12.

The cutting tool 46 has a supporting body 54 in the form of a frame with an abutment surface 56 for abutment against the second surface 8 of the workpiece arrangement 4 and with an opening 70 starting from the abutment surface 56 and extending perpendicularly along a central axis 62, into which the part of the blind rivet 2 protruding from the hole 10 at the second surface 8, in particular the threaded portion 32 and the deformation portion 30 of the shell 12, can extend and which is matched to the outer shape of the threaded portion 32 of the shell 12 and of the stem portion 38 of the screw 14. The two blades 50 with opposite cutting edges 48 are arranged in the opening 70 so as to be movable in a guided manner in such a way that the cutting edges 48 extend perpendicularly to the central axis 62 and can be moved toward the central axis 62 in the radial direction from opposite sides.

For cutting the shell 12, the cutting tool 46 is arranged on the workpiece arrangement 72 in such a way that the abutment surface 56 rests against the second surface 8, and the blind rivet 2 extends through the opening 70, with the result that the center axis 16 runs coaxially with the central axis 62, after which the blades 50 are moved toward the shell 12 simultaneously from opposite sides along the second surface 8, and cut the latter at the transition between the deformation portion 30 and the straight portion 26.

Figure 11:
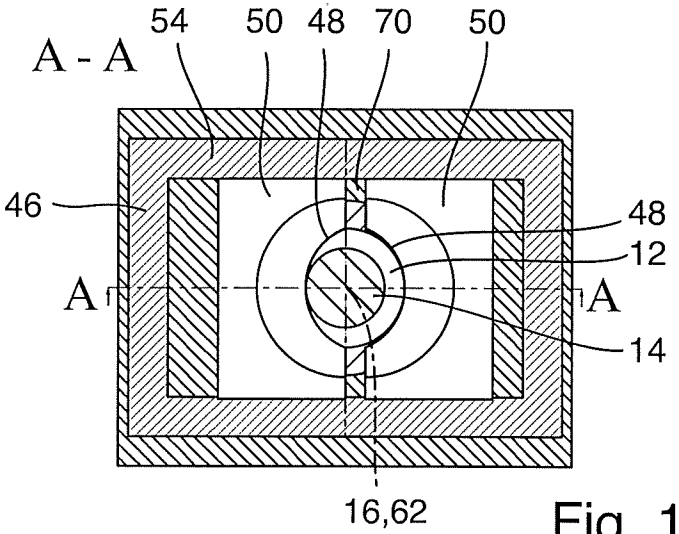
FIGS. 11, 12 and 13 show cross-sectional views perpendicular to the central axis of various embodiments of a cutting tool for use in the method according to the disclosure herein in accordance with the second embodiment.
Figure 12:
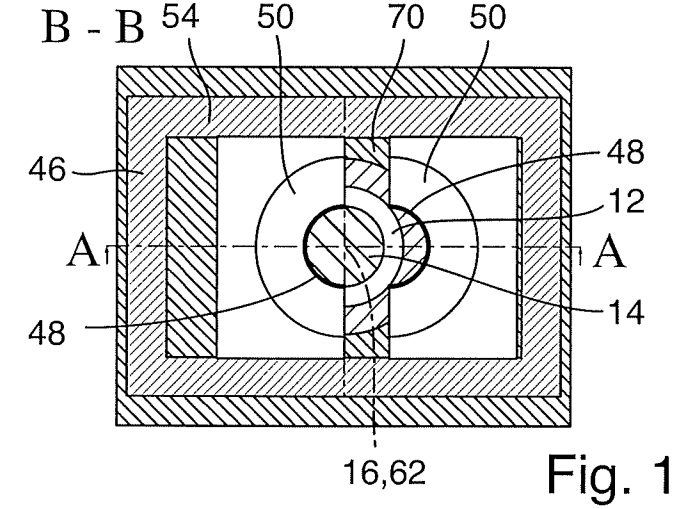
Figure 13:
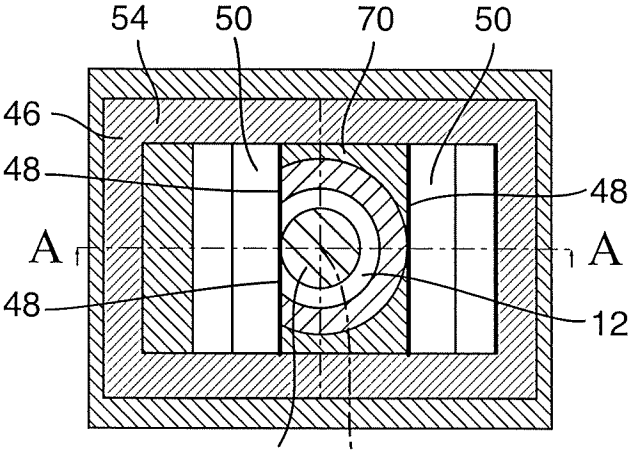

Depending on the radius of curvature of the cutting edges 48, several cuts must be carried out in order to completely cut the shell 12, wherein the cutting tool 46 is rotated about the center axis 16 between the cuts, for example by 90°, ensuring that the cuts are made at different angles. The larger the radius of curvature, the more cuts are required. FIGS. 11 and 12 show example embodiments of the cutting tool 46 with further, likewise possible radii of curvature, and FIG. 13 shows an example embodiment with straight cutting edges 48. In the case of straight cutting edges 48, the shell 12 can then be cut continuously in the circumferential direction by rotating the cutting tool 46 relative to the shell 12 about the center axis 16.

Figure 8:
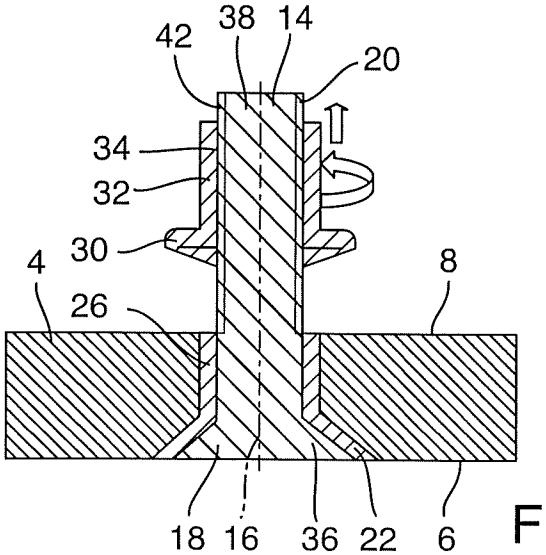
FIG. 8 shows a cross-sectional view parallel to the center axis of the blind rivet shown in FIG. 1 while the threaded portion and the deformation portion of the shell are being unscrewed from the screw in accordance with the second embodiment of the method according to the disclosure herein.

As shown in FIG. 8, after the cutting of the shell 12, the threaded portion 32 and the deformation portion 30 are unscrewed from the external thread 42 of the screw 14 and removed on the same side as the second surface 8. The removal of the deformation portion 30 thus also involves the removal of the abutment on the same side as the second surface 8, enabling the screw 14 and the remaining parts of the shell 12 to be removed on the opposite side, on which the first surface 6 is situated.

Figure 9:
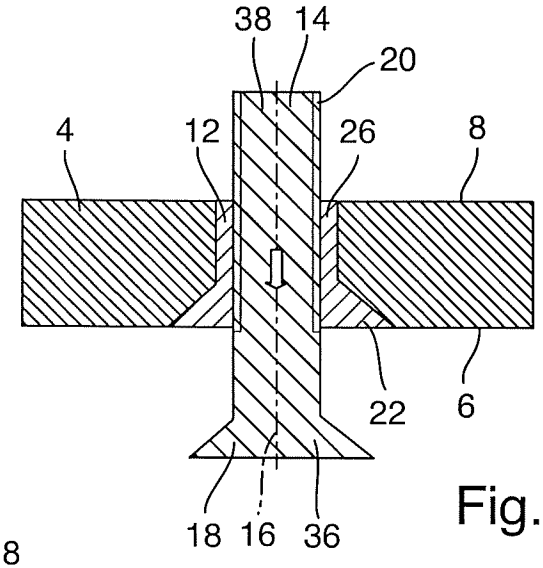
FIG. 9 shows a cross-sectional view parallel to the center axis of the blind rivet shown in FIG. 1 while the screw is being removed in accordance with the second embodiment of the method according to the disclosure herein.

FIG. 9 shows how, after the removal of the threaded portion 32 and of the deformation portion 30, the screw 14 is removed in the direction of the first surface 6.

Figure 10:
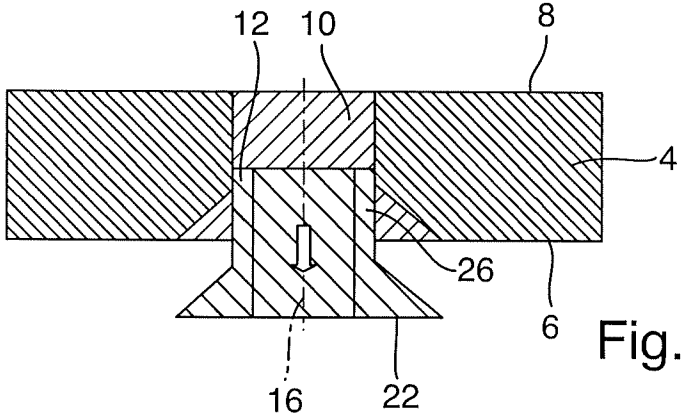
FIG. 10 shows a cross-sectional view parallel to the center axis of the blind rivet shown in FIG. 1 while the remaining parts of the shell are being removed in accordance with the second embodiment of the method according to the disclosure herein.

After the removal of the screw 14 or at the same time as the removal of the screw 14, the straight portion of the shell 12 and the shell head portion 22 are removed in the direction of the first surface 6, as illustrated in FIG. 10. The blind rivet 2 has thus been completely removed from the hole 10.

Figure 14:
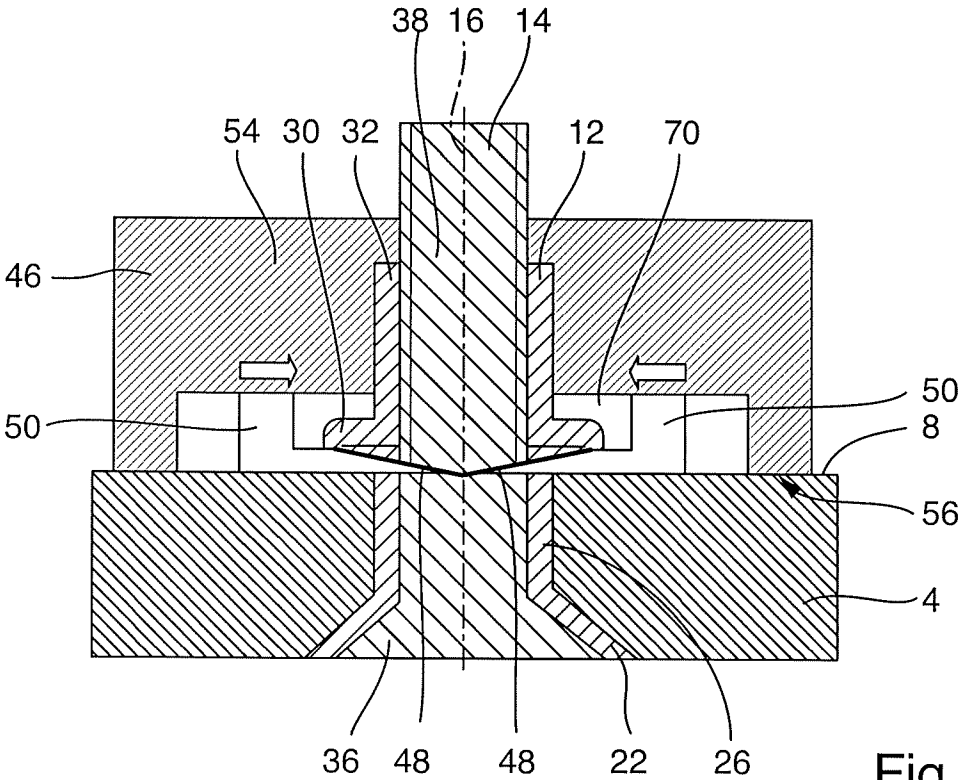
FIG. 14 shows a cross-sectional view parallel to the center axis of the blind rivet shown in FIG. 1, which is being removed in accordance with a third embodiment of the method according to the disclosure herein.

According to the third embodiment of the method according to the disclosure herein for removing the blind rivet 2, which is illustrated in FIG. 14, the shell 12 is, as in the second embodiment, cut with at least one cut perpendicular to the center axis 16 at the transition between the deformation portion 30 and the straight portion 26 and along an extension of the second surface 8. According to the third embodiment, however, the screw 14 extending in the shell 12 is cut through at the same time as the shell 12 is cut. After this, the remaining part of the screw 14 as well as the straight portion of the shell 12 and the shell head portion 22 are removed either at the same time or in succession in the direction of the first surface 6.

The invention claimed is:

1. A method for removing a blind rivet in a workpiece arrangement, comprising:

providing a workpiece arrangement having a first surface and an opposite second surface and having a hole, which connects the first surface to the second surface, wherein a blind rivet is fixed in the hole, the blind rivet having a shell and a screw extending through the shell, wherein the shell and the screw arranged therein extend coaxially along a common center axis between a first end on a same side as the first surface and a second end on a same side as the second surface of the workpiece arrangement, wherein the shell has a shell head portion with a diameter which is greater than a diameter of the hole in the workpiece arrangement, a straight portion, an outside diameter of which is less than or equal to the diameter of the hole, a deformation portion and a threaded portion having an internal thread, wherein the straight portion is located in the hole and the deformation portion and the threaded portion protrude from the hole on the same side as the second surface, wherein the screw has a screw head portion with a diameter which is greater than the diameter of the hole, and a stem portion, the diameter of which is less than or equal to the inside diameter of the shell, wherein, when viewed along the center axis, at least part of the stem portion has an external thread, wherein the screw is in the shell such that the internal thread of the shell engages in an external thread of the screw and the deformation portion of the shell is deformed, wherein the outside diameter of the deformed deformation portion is greater than the diameter of the hole, cutting the shell in the region of the threaded portion and or of the deformation portion; and removing the blind rivet from the hole.

2. The method of claim 1, wherein the shell is cut with a cut parallel to the center axis.

3. The method of claim 2, wherein the cut extends at least along the threaded portion.

4. The method of claim 2, wherein the cutting of the shell is performed with a cutting tool, wherein the cutting tool has a blade with a straight cutting edge which is moved toward the shell in a radial direction toward the center axis while aligned parallel to the center axis.

5. The method of claim 4, wherein the cutting tool has a supporting body with an abutment surface and a bore starting from the abutment surface and with a guide slot extending radially outward from the bore, wherein the blade is in the guide slot and movable in a guided manner such that the cutting edge extends parallel to the central axis of the bore and can be moved into the bore and toward the central axis.

6. The method of claim 5, wherein, for cutting the shell, the cutting tool is arranged such that the abutment surface rests against the second surface of the workpiece arrangement, and the blind rivet protrudes from the hole at the second surface extends into the bore, after which the blade is moved toward the shell in a direction of the center axis in the guide slot until the cutting edge cuts the shell.

7. The method of claim 5, wherein one or more further cutting edges are provided on the inner wall of the bore at a distance from the guide slot in a circumferential direction, the cutting edges extending parallel to the central axis and against which the threaded portion rests when the latter is located in the bore.

8. The method of claim 1, wherein, after the cutting of the shell, the screw is removed in a direction of the first surface.

9. The method of claim 8, wherein the removal of the screw is effected by striking a second end of the screw.

10. The method of claim 8, wherein, after the removal of the screw, the shell head portion is drilled out from the same side as the first surface and then removed.

11. The method of claim 10, wherein, after the removal of the shell head portion, remaining parts of the shell are removed on the same side as the second surface.

12. The method of claim 1, wherein the shell is cut with a cut transverse to the center axis.

13. The method of claim 12, wherein the shell is cut at a transition between the deformation portion and the straight portion.

14. The method of claim 12, wherein the shell is cut along an extension of the second surface.

15. The method of claim 12, wherein, during the cutting of the shell, several cuts are made from different sides of the shell.

16. The method of claim 12, wherein the cutting of the shell is performed with a cutting tool, wherein the cutting tool has a blade with a cutting edge which is moved toward the shell in a radial direction toward the center axis while aligned perpendicularly to the center axis.

17. The method of claim 16, wherein the cutting edge is moved between the second surface and the deformation portion in order to cut the shell.

18. The method of claim 16, wherein several cuts are carried out in order to cut the shell, wherein the cutting tool is rotated about the center axis relative to the shell between the cuts, ensuring that the cuts are made at different angles.

19. The method of claim 16, wherein, in order to cut the shell, the cutting edge is first moved toward the shell in the radial direction toward the center axis, and then the cutting tool is rotated about the center axis, wherein the cutting edge cuts the shell continuously in a circumferential direction.

20. The method of claim 16, wherein the blade is concavely curved relative to the shell.

21. The method of claim 20, wherein the cutting edge has a radius of curvature greater than or equal to the internal radius of the shell.

22. The method of claim 16, wherein the cutting tool has two blades with opposite cutting edges, which are moved toward the shell from opposite sides in order to cut the shell.

23. The method of claim 22, wherein the cutting tool has a supporting body with an abutment surface and an opening starting from the abutment surface and having a central axis perpendicular to the abutment surface, wherein the two blades with opposite cutting edges are in the opening and movable in a guided manner such that the cutting edges extend perpendicularly to the central axis and can be moved toward the central axis in the radial direction from opposite sides.

24. The method of claim 23, wherein, for cutting the shell, the cutting tool is arranged on the workpiece arrangement such that the abutment surface rests against the second surface, and the blind rivet extends into the opening, wherein the center axis runs coaxially with the central axis, after which the blades are moved toward the shell from opposite sides and cut the latter.

25. The method of claim 12, wherein, after the cutting of the shell, the threaded portion and the deformation portion are unscrewed from the external thread of the screw and removed on the same side as the second surface.

26. The method of claim 25, wherein, after the removal of the threaded portion and of the deformation portion, the screw is removed in a direction of the first surface.

27. The method of claim 26, wherein, after the removal of the screw or at a same time as the removal of the screw, the straight portion of the shell and the shell head portion are removed in the direction of the first surface.

28. The method of claim 12, wherein, with the cutting of the shell, the screw extending in the shell is cut through at the same time, after which the remaining part of the screw as well as the straight portion of the shell and the shell head portion are removed in a direction of the first surface.

29. A cutting tool for removing a blind rivet in a workpiece arrangement, comprising:

the workpiece arrangement having a first surface and an opposite second surface and a hole, which connects the first surface to the second surface;

a blind rivet fixed in the hole, the blind rivet having a shell and a screw extending through the shell;

the shell and the screw arranged therein extending coaxially along a common center axis between a first end on a same side as the first surface and a second end on a same side as the second surface of the workpiece arrangement;

the shell having a shell head portion with a diameter which is greater than a diameter of the hole in the workpiece arrangement, an adjoining straight portion, an outside diameter of which is less than or equal to the diameter of the hole, a deformation portion, and a threaded portion having an internal thread, wherein the straight portion is in the hole and the deformation portion and the threaded portion protrude from the hole on the same side as the second surface;

the screw having a screw head portion with a diameter which is greater than the diameter of the hole, and a stem portion, a diameter of which is less than or equal to an inside diameter of the shell, wherein, when viewed along the center axis, at least part of the stem portion has an external thread;

wherein the screw is arranged in the shell such that the internal thread of the shell engages in an external thread of the screw and the deformation portion of the shell is deformed, wherein the outside diameter of the deformed deformation portion is greater than the diameter of the hole; and the cutting tool having a supporting body with an abutment surface and a bore starting from the abutment surface and with a guide slot extending radially outward from the bore, wherein a blade with a straight cutting edge is in the guide slot and movable in a guided manner such that the cutting edge extends parallel to the central axis of the bore and can be moved into the bore and toward the central axis;

wherein a shape of the bore is matched to an outer shape of the threaded portion and of the deformation portion.

30. The cutting tool of claim 29, wherein one or more further cutting edges are on the inner wall of the bore at a distance from the guide slot in the circumferential direction, which cutting edges extend parallel to the central axis and against which the threaded portion rests when the latter is located in the bore.

31. A cutting tool for removing a blind rivet in a workpiece arrangement, comprising:

the workpiece arrangement having a first surface and an opposite second surface and a hole, which connects the first surface to the second surface;

a blind rivet fixed in the hole, the blind rivet having a shell and a screw extending through the shell;

the shell and the screw arranged therein extending coaxially along a common center axis between a first end on a same side as the first surface and a second end on a same side as the second surface of the workpiece arrangement;

the shell having a shell head portion with a diameter which is greater than a diameter of the hole in the workpiece arrangement, an adjoining straight portion, an outside diameter of which is less than or equal to the diameter of the hole, a deformation portion and, finally, a threaded portion having an internal thread, wherein the straight portion is in the hole and the deformation portion and the threaded portion protrude from the hole on the same side as the second surface;

the screw having a screw head portion with a diameter which is greater than the diameter of the hole, and a stem portion, a diameter of which is less than or equal to an inside diameter of the shell, wherein, when viewed along the center axis, at least part of the stem portion has an external thread;

wherein the screw is arranged in the shell such that the internal thread of the shell engages in an external thread of the screw and the deformation portion of the shell is deformed, wherein the outside diameter of the deformed deformation portion is greater than the diameter of the hole; and the cutting tool having a supporting body with an abutment surface and an opening starting from the abutment surface and having a central axis perpendicular to the abutment surface, wherein two blades with opposite cutting edges are in the opening and movable in a guided manner such that the cutting edges extend perpendicularly to the central axis and can be moved toward the central axis in the radial direction from opposite sides;

wherein a shape of the bore is matched to an outer shape of the threaded portion and of the deformation portion.

* * * * *